US005679174A

United States Patent [19]

Buongiorno

[11] Patent Number: 5,679,174

[45] Date of Patent: Oct. 21, 1997

[54] PROCESS AND APPARATUS FOR CLEANING GAS TURBINE ENGINE COMPONENTS

[75] Inventor: Angelo Buongiorno, Wanaque, N.J.

[73] Assignee: Chromalloy Gas Turbine Corporation, Orangeburg, N.Y.

[21] Appl. No.: 549,036

[22] Filed: Oct. 27, 1995

[51] Int. Cl.[6] ..... B08B 9/093

[52] U.S. Cl. ..... 134/22.18; 134/1; 134/4; 134/13; 134/22.1; 134/22.12; 134/39

[58] Field of Search ..... 134/1, 4, 13, 22.1, 134/22.12, 22.18, 39

[56] References Cited

U.S. PATENT DOCUMENTS

| | | | |
|---|---|---|---|
| 2,509,197 | 5/1950 | Borus et al. | 252/118 |
| 3,074,822 | 1/1963 | Walk et al. | 134/7 |
| 3,400,017 | 9/1968 | Heubner et al. | 134/7 |
| 4,141,127 | 2/1979 | Cretella et al. | 29/89.1 |
| 4,356,084 | 10/1982 | Hatton et al. | 209/211 |
| 4,403,735 | 9/1983 | Weaver | 239/1 |
| 4,439,241 | 3/1984 | Ault et al. | 134/22.18 X |
| 4,713,120 | 12/1987 | Hodgens et al. | 134/3 |
| 4,834,912 | 5/1989 | Hodgens et al. | 252/545 |
| 5,054,247 | 10/1991 | Rhoades et al. | 451/36 |
| 5,135,014 | 8/1992 | Beswick | 134/60 |
| 5,290,364 | 3/1994 | Stein et al. | 134/22.18 X |
| 5,409,545 | 4/1995 | Levey et al. | 134/22.18 |
| 5,464,479 | 11/1995 | Kenton et al. | 134/22.1 X |
| 5,507,306 | 4/1996 | Irvine et al. | 134/166 R |

*Primary Examiner*—Arlen Soderquist
*Attorney, Agent, or Firm*—Mitchell D. Bittman

[57] ABSTRACT

A process and apparatus is provided for cleaning deposits from gas turbine engine components, particularly turbine blades, by locating or drilling a hole into the cavity of the component, inserting a cleaning tube into the cavity and cleaning the deposits from the cavity with a cleaning material inserted into the cavity through the tube, followed by sealing any hole drilled in the component.

20 Claims, 3 Drawing Sheets

PROCESS AND APPARATUS FOR CLEANING GAS TURBINE ENGINE COMPONENTS

BACKGROUND

Gas turbine engines have been constantly improved over the years and operating temperatures have been increased. This greatly augmented power output and efficiency. Operating temperatures in the hottest sections of the engine have even increased beyond the melting temperatures of the superalloy metals of the turbine components, particularly turbine blades. Among the various techniques used to maintain the temperature of the components' metal at a safe operating temperature is to utilize various and complex internal cooling passages within the components. A problem experienced with the use of such passages is that when the gas turbine engine is operated over time deposits can build-up which can partially or totally block these internal passages. The deposits can comprise metal debris from the wear of components, fuel deposits, airborne particles or other pollutants, metal oxides, silica etc.

Various techniques have been utilized to clean gas turbine engine components generally involving placing the component into a cleaning solution bath (see for example U.S. Pat. Nos. 2,509,197, 4,713,120 and 4,834,912). Other techniques involves using solid particles as in U.S. Pat. Nos. 3,074,822 and 3,400,017. Still other techniques involve the use of acoustic vibrations as in U.S. Pat. No. 4,403,735. However, due to the compacting of the debris in the internal passages these cleaning processes may not be successful in removing the debris and the component would have to be scraped as non-repairable. This accumulation of difficult to remove debris has been particularly evident in the upper portion of the trailing edge and leading edge cavities of turbine blades.

Thus it is an object of this invention to provide a process to clean the internal cavities of gas turbine engine components, particularly turbine blades.

It is a further object of this invention to provide a cleaning process which does not damage or degrade the external or internal surfaces of the component.

SUMMARY

Briefly, the objects of this invention are provided by a process and apparatus for cleaning deposits from an internal cavity of a gas turbine engine component by locating or drilling a hole into the cavity of the component, inserting a cleaning tube through the hole into the cavity, cleaning the deposits from the cavity with a cleaning material inserted into the cavity through the tube, followed by sealing any hole drilled in the component.

DETAILED DESCRIPTION OF THE INVENTION

A process and apparatus is provided for cleaning deposits and debris which accumulate in the cavities of gas turbine engine components, particularly in the internal passages of turbine blades.

Figure 4:
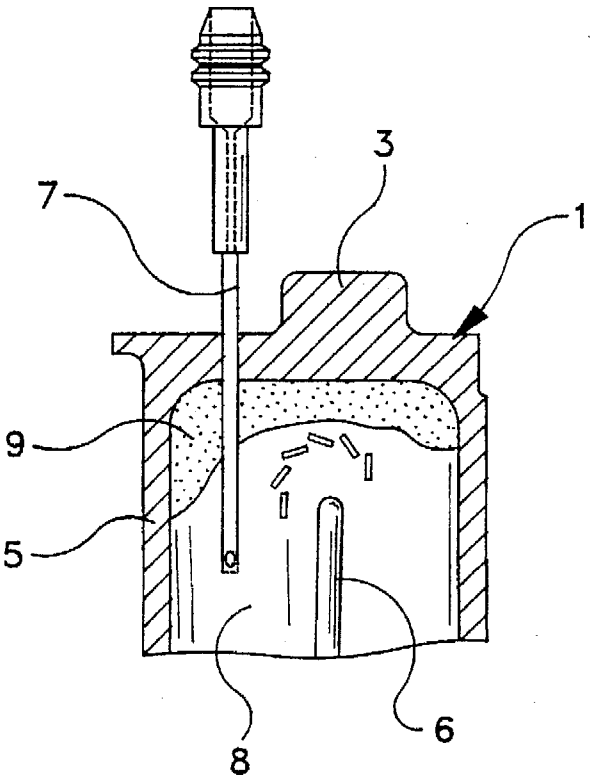
FIG. 4 is a side cross sectional view of a turbine blade being cleaned with the tube inserted through a hole drilled into the shroud of the blade.
Figure 3:
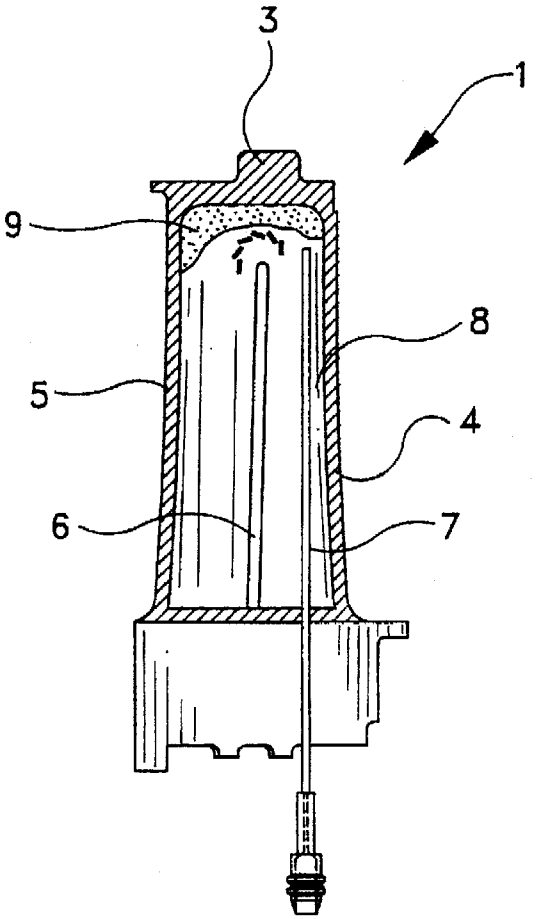
FIG. 3 is a side cross sectional view of a turbine blade being cleaned with the tube inserted through a hole located in the root of the blade.

In order to clean the blade a hole is located which provides access into the cavity of the component where the deposits are accumulated. If a suitable hole is not available through the component designed air passages to access the deposits, a hole is drilled into the cavity. When drilling a hole, it is important to select an area which provides access to the deposits in the cavity, but will also not detrimentally affect the integrity of the component. As shown in FIG. 3, an air passageway hole is located in the root (2) which provides access to deposits (9) in the leading edge (4) of the blade (1). As shown in FIG. 4, to provide access to deposits (9) in the trailing edge (5) of the blade (1) a hole is drilled into an end, i.e. the blade tip or shroud (3). Care is taken to avoid drilling into the surfaces of the airfoil which are exposed to the harsh thermal environment, which include the leading edge (4) and trailing edge (5) of the turbine blade. In one embodiment, for a JT8D, first stage blade a hole is drilled into the shroud about 0.4 to 0.5 inches from the trailing edge (5) of the turbine blade (1). The hole is drilled without striking a wall surface, so as not to damage the external or internal surfaces of the component. A suitable method of drilling includes electrode discharge machining the hole. The hole has a diameter suitable for insertion of the cleaning tube. Typically the hole can have a diameter of about 0.01 to 0.15 inches, preferably about 0.02 to 0.04 inches.

Into the hole that is located or drilled into the component a cleaning tube is inserted. The tube is slightly smaller than the drilled hole, generally with at least 0.002 inches clearance. The tube that is utilized should be suitable for inserting a cleaning material into the cavity of the component in order to clean the cavity. Advantageously, the tube can be inserted into the component to a location in the cavity proximate to the deposits and positioned within the cavity to deliver cleaning material directly to the deposits to facilitate their removal. The tube can be in the form of a needle and can be designed to deliver the cleaning material directly to the deposits. The cleaning tube (7) shown in FIG. 3 has an opening (8) at the end for the straight forward delivery of the cleaning material to the deposits (9) in the upper portion of the leading edge (4), while as shown in FIG. 4 a cleaning needle (7) is used which has an opening (8) at ninety degrees to deliver the cleaning material directly to the deposits (9) in the upper portion of the trailing edge (5) of the turbine blade (1). The component can be rotated and the cleaning tube can be rotated, shaped and moved around (in and out) to facilitate cleaning the deposits.

The cleaning material is inserted through the cleaning tube into the cavity of the component. The cleaning material is any material suitable for removing the deposits and can include gas, steam or particles. A preferred cleaning material is a liquid such as a solvent or an aqueous solution including water. Preferably and advantageously the cleaning material can be inserted under pressure directly to the deposits to help dislodge the deposits. A preferred liquid is water which can be inserted under pressure, typically about 4,000–20,000 psi, preferably 7,000–13,000 psi. The water can also be heated to assist cleaning, with heating up to 212° F., preferably 140° F. to 180° F. being useful.

After the cavity of the component has been cleaned it is inspected, typically by x-ray to insure that the deposits have been removed. If any deposits are detected then the component can be further cleaned until all deposits are removed.

Following cleaning, any hole drilled into the component is sealed to return the component to the manufacturer's specifications. A suitable method of sealing the hole involves laser plug welding, i.e. wherein a pin or plug of a suitable alloy is inserted into the hole and the pin is laser welded into the hole.

Figure 1:
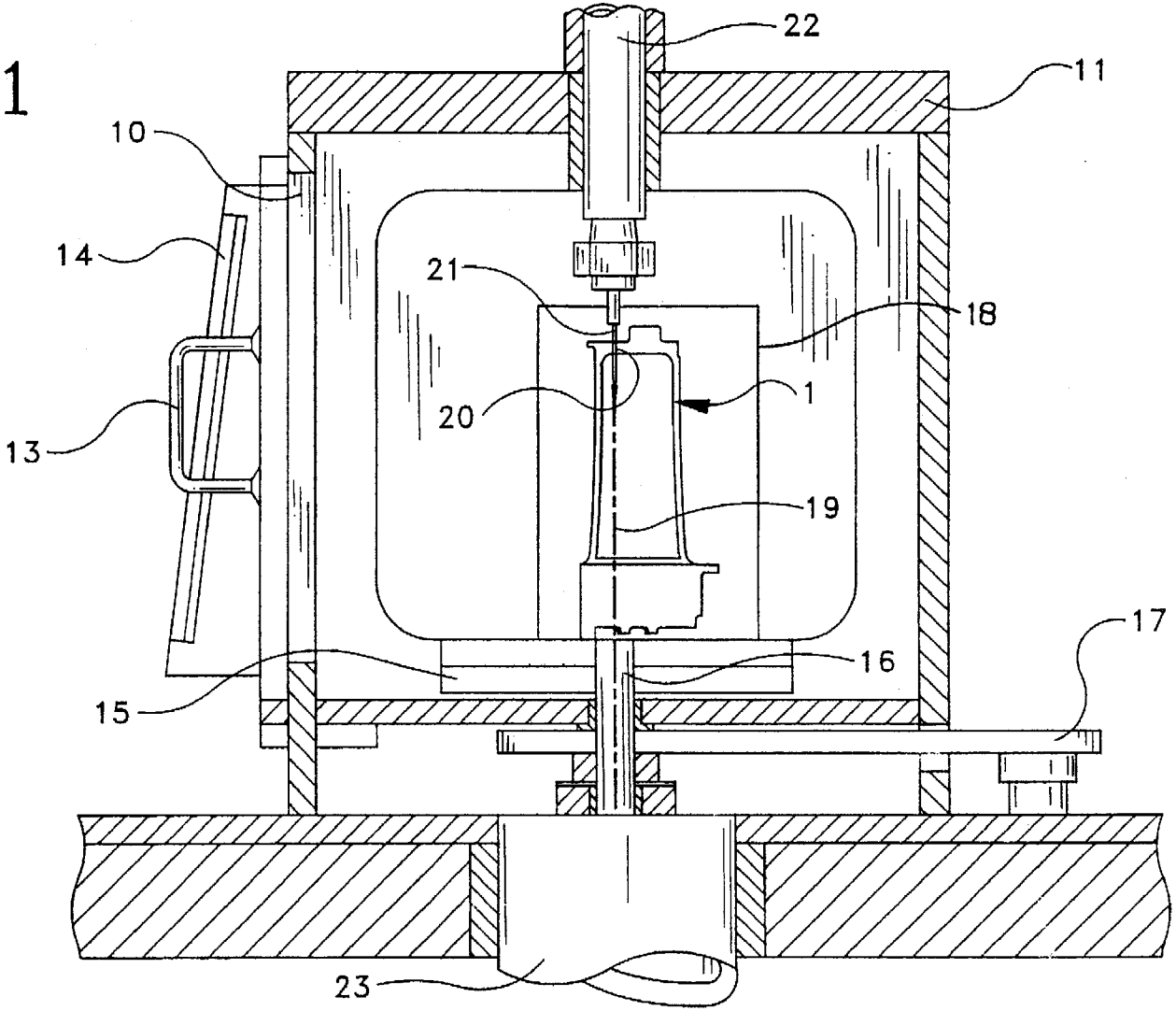
FIG. 1 is a side cross sectional view of a cleaning apparatus with a rotating platform.

Referring to FIG. 1 an apparatus is shown which can be used to carry out this invention. The apparatus comprises a chamber (10) having a cover (11) and a door (12) with a handle (13) to allow easy access into the chamber. The door (12) includes a window (14) for viewing the cleaning operation. Inside the chamber (10) is a rotating platform (15) which is on shaft (16) which is rotated using a chain and sprocket (17) attached to a motor (not shown). Other suitable means for rotating the platform may be employed. The component (1) is mounted to a component holding fixture (18) on the platform (15) with the hole (20) in the component being aligned with the central axis (19) of the rotating platform (15). A cleaning tube (21) is provided aligned with the central axis (19) for insertion into the hole (20) in the component (1). The apparatus also includes a pressurized source of cleaning material which is delivered to the cleaning tube (21 ) through input shaft (22). This pressure source can be a tank of cleaning material with a pump to provide the material under pressure. A drain pipe (23) is also included to remove cleaning material. A means is preferably included to lower and raise input shaft (22), e.g. by cam action, in order to facilitate placement of the component and placement of the cleaning tube (21) in a desired position within the component (1) for cleaning.

Figure 2:
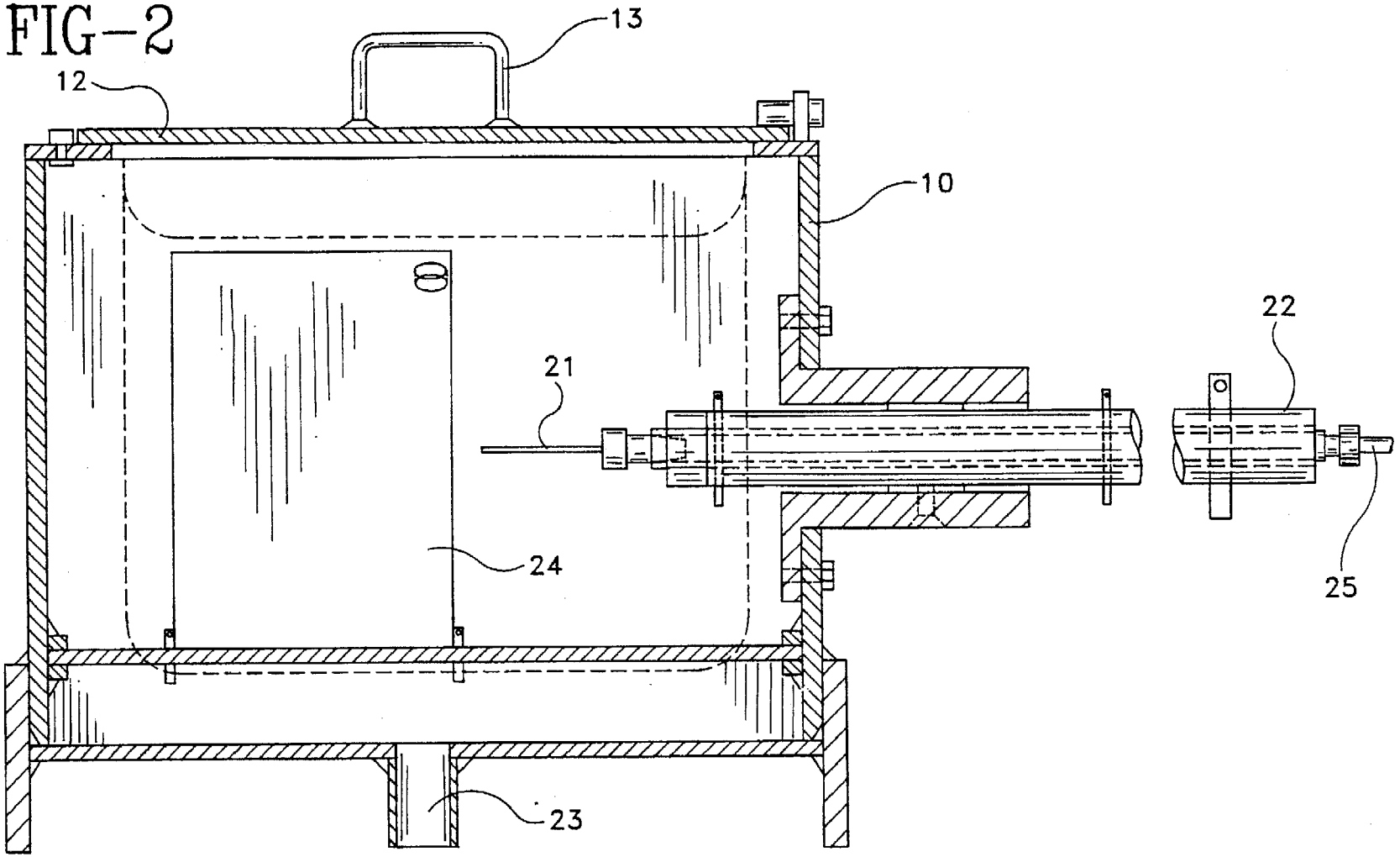
FIGS. 2 is a side cross sectional view of a cleaning apparatus with a stationary platform.

Referring to FIG. 2, an alternate apparatus is provided for carrying out this invention. As with FIG. 1, the apparatus of FIG. 2 also comprises a chamber (10), although in a horizontal position, a door (12) and handle (13). However, inside the chamber (10) of FIG. 2 the platform (24) is stationary. A component would be mounted to a holding fixture (not shown) with the fixture mounted on the platform (24) with the hole in the component being aligned with the cleaning tube (21) for insertion of the cleaning tube into the hole in the component. This apparatus also includes a pressurized source of cleaning material (25) which is delivered to the cleaning tube (21) through input shaft (22) and a drain (23) is provided to remove cleaning material. A means is also provided for extending and retracting the input shaft (22).

EXAMPLE I

Utilizing both the apparatus illustrated in FIGS. 1 and 2 a high pressure water pump was attached for delivering water at approximately 2.4 gallons per minute at 10,000 to 13,000 psi.

The following procedure was followed to clean a JT8D first blade which had accumulated deposits in the upper trailing edge and leading edge cavities.

The blade was mounted in a fixture and the fixture mounted on the platform of the apparatus shown in FIG. 2. The cleaning tube, a 0.035 inches diameter and 4.25 inches long straight flow needle, was inserted through an air passageway located in the root of the blade as shown in FIG. 3 to a location proximate to the deposits to clean the deposits located in the upper potion of the leading edge. A high pressure water blast of 2 to 3 minutes at about 10,000 psi is utilized.

Then a 0.035 inch diameter hole was electrode discharge machined through the shroud of the blade, approximately 0.5 inches from trailing edge to 0.14 inches maximum depth. The hole is positioned central to the cavity sufficiently as not to induce any wall strikes. Subsequently, in the horizontal chamber of FIG. 2 the blade is mounted and water is injected through the electrode discharge machined hole with a straight flow needle to blast a hole through the debris providing access for the 90 degree needle.

The blade is then mounted in a fixture within the cleaning apparatus of FIG. 1 and water is blasted using an 0.028 inch diameter needle with a 0.014 inch diameter 90 degree hole for approximately 5 minutes at about 10,000 psi. The location of the debris is targeted and the needle is brought to a location proximate the debris with the component being rotated and the needle raised and lowered as required to assure that all surfaces inside the cavity are clean.

The cleaned part is x-rayed to insure complete removal of deposits and the absence of wall strikes. If additional debris is found the cleaning is repeated as above.

A 0.036 inch diameter×0.125 inch long Inco 625 pin is pressed into the hole drilled into the blade, then laser plug-welding 360 degrees×approximately 0.030 inches deep.

What is claimed is:

1. Process for cleaning deposits from an internal cooling passage of a gas turbine engine component comprising:

drilling a hole into the passage of the component;

inserting a cleaning tube through the hole and into the passage of the component;

cleaning the deposits from the passage of the component with a cleaning material inserted into the passage through the tube; and sealing the hole in the component.

2. Process of claim 1 wherein the component is a turbine blade and the hole is drilled into an end of the blade.

3. Process of claim 2 wherein the drilling of the hole in the end is carried out without striking a wall surface of the blade.

4. Process of claim 3 wherein the drilling is carried out by electrode discharge machining.

5. Process of claim 3 wherein the hole has a diameter of about 0.01 to 0.15 inches.

6. Process of claim 5 wherein the hole is drilled about 0.4 to 0.5 inches from a trailing edge of the blade.

7. Process of claim 5 wherein the cleaning material is a fluid which is sprayed under pressure to clean the deposits.

8. Process of claim 7 wherein the tube is a needle with an opening at 90 degrees.

9. Process of claim 8 wherein the blade is rotated while the fluid is sprayed to clean the deposits.

10. Process of claim 7 wherein the fluid is water sprayed at a pressure of from 4,000 to 20,000 psi.

11. Process of claim 10 wherein the water is heated.

12. Process of claim 3 wherein the hole is sealed by laser plug welding.

13. Process of claim 1 wherein the tube is inserted to a location in the passage proximate to the deposits.

14. Process of claim 13 wherein the tube delivers the cleaning material directly to the deposits.

15. Process for cleaning deposits from an internal cooling passage of an airfoil of a gas turbine engine component comprising;

locating a hole in the passage of the component;

inserting a cleaning tube through the hole into the passage of the airfoil to a location in the passage proximate to the deposits;

cleaning deposits from the passage of the airfoil with a cleaning material inserted into the passage through the tube.

16. Process of claim 15 wherein the component is a turbine blade.

17. Process of claim 16 wherein the cleaning material is a fluid which is sprayed under pressure to clean the deposits.

18. Process of claim 17 wherein the fluid is water sprayed at a pressure of from 4,000 to 20,000 psi.

19. Process of claim 18 wherein the water is heated.

20. Process of claim 15 wherein the tube delivers the cleaning material directly to the deposits.

* * * * *